US005164641A

United States Patent [19]

Quibel et al.

[11] Patent Number: 5,164,641

[45] Date of Patent: Nov. 17, 1992

[54] APPARATUS AND METHOD FOR CONTROLLING THE FREQUENCY OF VIBRATION OF A COMPACTING MACHINE

[75] Inventors: Alain J. Quibel, Saint Etienne du Rouvray; Michel M. Aubourg, Senlis; Michel H. Froumentin, Isneauville; René G. Divay, Clermont, all of France

[73] Assignee: Caterpillar Paving Products Inc., Minneapolis, Minn.

[21] Appl. No.: 607,932

[22] Filed: Nov. 1, 1990

[51] Int. Cl.[5] ..... B64C 17/02

[52] U.S. Cl. ..... 318/128; 318/608; 318/648; 404/117; 73/573; 364/505; 51/163.1; 51/163.2

[58] Field of Search ..... 318/128, 139, 560–640, 318/648; 51/163.1, 163.2; 404/103, 117, 123, 133.05; 73/573, 78, 82, 84; 180/20, 21; 364/500, 551, 155, 154, 505

[56] References Cited

U.S. PATENT DOCUMENTS

| | | | |
|---|---|---|---|
| Re. 31,195 | 4/1983 | Thurner | 73/573 |
| 3,599,543 | 8/1971 | Kerridge | 94/50 |
| 3,797,954 | 3/1974 | Harris | 404/117 |
| 3,870,226 | 3/1975 | Leroy | 364/511 |
| 4,149,253 | 4/1979 | Paar et al. | 404/117 X |
| 4,212,071 | 7/1980 | Dortu | 364/505 |
| 4,330,738 | 5/1982 | Paramythioti et al. | 318/128 |
| 4,348,901 | 9/1982 | Vural et al. | 73/594 |
| 4,467,652 | 8/1984 | Thurner et al. | 73/573 |
| 4,546,425 | 10/1985 | Breitholtz | 364/551 X |
| 4,734,846 | 3/1988 | Konig | 73/573 X |
| 4,870,601 | 9/1989 | Sandstrom | 404/117 X |

*Primary Examiner*—Paul Ip
*Attorney, Agent, or Firm*—Robert A. McFall

[57] ABSTRACT

An apparatus and a method are provided for controlling the frequency of vibration of a compacting machine. The frequency control is carried out by the apparatus which determines the actual time at which a ground contacting member of the compacting machine is at its true vertically lowest position. This is determined by measuring the time at which the vertical acceleration of the ground contacting member has a maximum value during one rotation of an eccentrically mounted, vibration inducing mass. The time difference between the time at which the vibration inducing eccentric mass is at predetermined position and the time at which the acceleration of the ground contacting member is at the maximum value is used to calculate a phase angle relationship ($\phi$) between the ground contacting member and the eccentrically attached member. This method of determining the phase angle relationship ($\phi$) between the two members provides an accurate parameter for controlling the frequency of vibration imparted to a compactible material by the compacting machine.

6 Claims, 13 Drawing Sheets

802
FIRST PASSAGE ?
N
Y
804
SET DISTANCE = 0
806
INITIALIZE REAL TIME CYCLE
A
724
808
HOMOGENEITY SELECTED ?
N
Y
812
DISPLAY INSTANTANEOUS INFORMATION
810
DISPLAY DISTANCE AND TAF

APPARATUS AND METHOD FOR CONTROLLING THE FREQUENCY OF VIBRATION OF A COMPACTING MACHINE

DESCRIPTION

1. Technical Field

This invention relates generally to an apparatus and method for increasing the density of a compactible material with a vibrating tool and more particularly to an apparatus and method for controlling the frequency of the vibrations imparted to the ground by the vibrating tool, 2. Background Art It is well known that the efficiency of a vibratory compactor depends on the impacting frequency of the material contacting element of the compactor, such as a drum or plate, against the material being compacted, such as soil, crushed gravel and similar materials. Tests have shown that the optimum value of the impacting frequency corresponds to the resonant frequency of the force couple between the contacting element, which includes the compacting machine, and the soil. Furthermore, the compacting force, i.e., the total applied force (TAF) imparted by the contacting element to the soil, has a maximum value at the resonant frequency.

The resonant frequency is dependent on several interrelated factors such as the physical characteristics of vibratory compactor, the mass of the eccentric member inducing vibration to the material contacting member, and the physical characteristics and density of the compactible material and of the underlying support material. These interrelationships require that the frequency adjustment be carried out continuously during a compaction operation to maintain resonant frequency conditions.

It is also known that the angular position of a rotating vibration inducing member with respect to a vertical reference position when the material contacting member is at its vertically lowest spatial position, hereinafter referred to as the phase relationship or phase angle ($\phi$), is a parameter that is particularly responsive to the resonant frequency.

Examples of frequency control systems based on the angular relationship. i.e., the phase angle, of the respective positions of a rotating eccentric mass and a material contacting member are described in French Patent No. 2,390,546 issued Jan. 12, 1979 to Albaret S. A. and in U.S. Pat. No. 3,797,954 issued Mar. 19, 1974 to Jesse W. Harris. However, these arrangements have some inherent limitations which limit their effectiveness. Both systems use a sensor mounted on the chassis to measure the amplitude of the displacement of the drum. The drum in both arrangements, as commonly found in vibratory compactors, is attached to the chassis by resilient mounts. However, the chassis itself is subjected to vertical displacement during operation, either from the vehicle drive train, or forces transmitted from the rotating drum to the chassis. Therefore, in these arrangements, the chassis mounted sensor is actually sensing the relative displacement between the chassis and drum, and not the actual spatial position of the drum. Thus arrangements of this type lack sufficient accuracy to effectively control the frequency of the eccentrically loaded rotating shaft.

A number of devices and methods have also been proposed for evaluating the density of a compactible material during the compaction operation. For example, U.S. Pat. No. 3,599,543 issued Aug. 17, 1971 to Kerridge measures the length of the major axis of the elliptical path of a point on the vehicle's vibrating roller with the length of the axis when the ground is fully compacted. Swedish Patent No. 76 08709, published Feb. 27, 1978 and issued to Heinz Thurner measures the amplitude of the vertical motion of the vibrating roller at a fundamental frequency and at one or more harmonic frequencies and calculates a ratio of the measured fundamental and harmonic frequencies. Swedish Patent No. 80 08299, published Jun. 28, 1982 and issued to Geodynamic Thurner AB et al, relates the degree of compaction to the shape of a waveform representative of the vertical movement of the vibratory compactor. More recently, Swedish Patent No. 84 05801 published May 20, 1986 and assigned to Geodynamic H. Thurner AB, describes an apparatus and method for estimating the degree of compaction of an oscillatory compactor by sensing the horizontal acceleration of the oscillating drum.

The values of the parameters measured by the above described devices and methods are influenced by the rotational frequency of the eccentrically mounted member. This often prevents the use of a vibratory compactor in the most efficient manner, i.e., adjusting the frequency of the eccentrically loaded rotary shaft to maintain operation of the compactor at the resonant frequency throughout the compaction operation.

The present invention is directed to overcoming the problems set forth above. It is desirable to have an apparatus and method for accurately controlling the frequency of the eccentrically loaded rotary shaft. It is also desirable to have such an apparatus and device that accurately determines, under varying operating conditions, the phase relationship between the eccentric mass and the elevationally lowest position of the ground contacting member. Furthermore, it is desirable to have such a frequency control arrangement that is associated with a system for continuously evaluating the density of the compacted material. Controllable adjustment of the impact frequency to maintain a resonant condition, simultaneously with continuous evaluation of material density, permits compaction operations to be carried out efficiently. Also, the quality of the compaction operation will be assured.

DISCLOSURE OF THE INVENTION

In accordance with one aspect of the present invention, an apparatus is provided for controlling the frequency of vibration of a compacting machine having a material contacting member, a shaft rotatably mounted on the material contacting member, a member eccentrically mounted on the shaft, and a means for rotating the shaft. The apparatus for controlling the frequency of vibration also includes means for sensing the presence of the eccentrically mounted member and producing a signal when the member is at a predetermined position. The apparatus further includes a means for producing a signal representative of the vertical acceleration of said material contacting member, a means for producing a timing signal, and means for determining the time at which the eccentrically mounted member is at the predetermined position, the time at which the acceleration signal has a maximum value, measuring the time difference between the position signal and the acceleration maximum value, calculating the value of a radial angle traversed by the eccentrically mounted member during the measured time difference, and producing a signal corresponding to the value of the calculated radial angle. The apparatus further includes a means for comparing the value of the calculated radial angle with a reference value and producing a control signal representative of the difference between the value of the calculated radial angle and the reference value.

Other features of the apparatus for controlling the frequency of vibration of the compacting machine include a means for measuring the time difference between the sensed eccentric member position signal and the acceleration maximum value signal during two consecutive cycles of the eccentrically mounted member, averaging the two measured time differences, calculating the average value of the radial angle traversed by the eccentrically mounted member during the two consecutive cycles, and producing a signal corresponding to the calculated averaged value of the radial angle.

In another aspect of the present invention, a method for controlling the frequency of vibration of a compacting machine includes producing a signal representative of the vertical acceleration of a material contacting member of the apparatus, producing a time signal, receiving the acceleration and time signals and a signal representative of the position of a member eccentrically attached to a rotatable shaft. The time at which the eccentrically attached member is at a predetermined position, and the time at which the acceleration signal has a maximum value are determined. The time difference between the position and acceleration maximum value signals are measured, and the value of the radial angle traversed by the eccentrically attached member during the measured time difference is calculated. A signal corresponding to the value of the calculated radial angle is produced and compared with a reference value. The difference between the calculated radial angle signal and the reference value provides the value for a control signal which controls the frequency of rotation of the eccentrically attached member.

Other features of the method for controlling the frequency of vibrations include measuring the time difference between the eccentric member sensed position signal and the acceleration maximum value signal for two consecutive cycles of the eccentrically attached member, averaging the two measured time differences, calculating the average value of the radial angle traversed by the eccentrically attached member during the two consecutive cycles, and producing a signal corresponding to the averaged value of the radial angle.

BEST MODE FOR CARRYING OUT THE INVENTION

Figure 1:
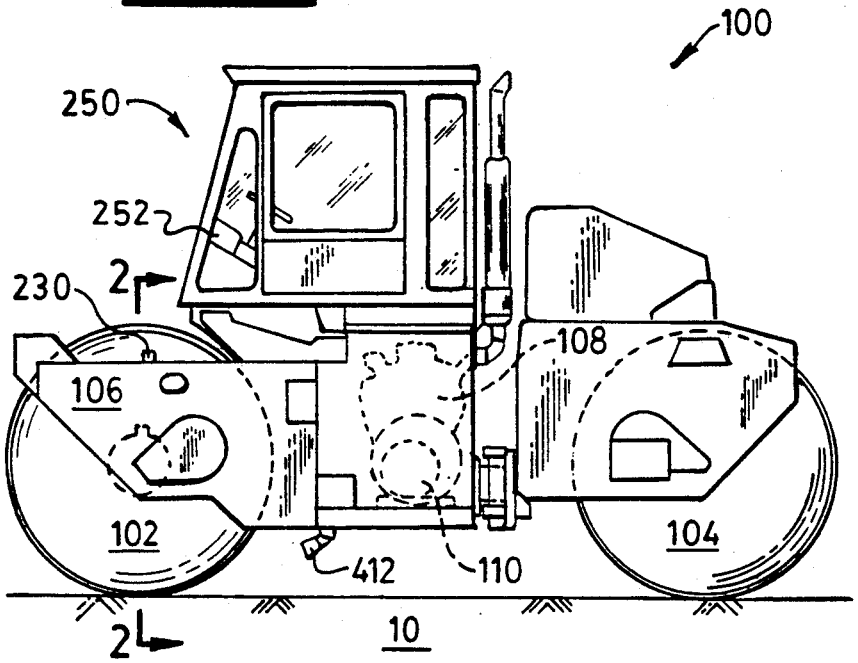
FIG. 1 is a side view of a vibratory compactor embodying the present invention.
Figure 2:
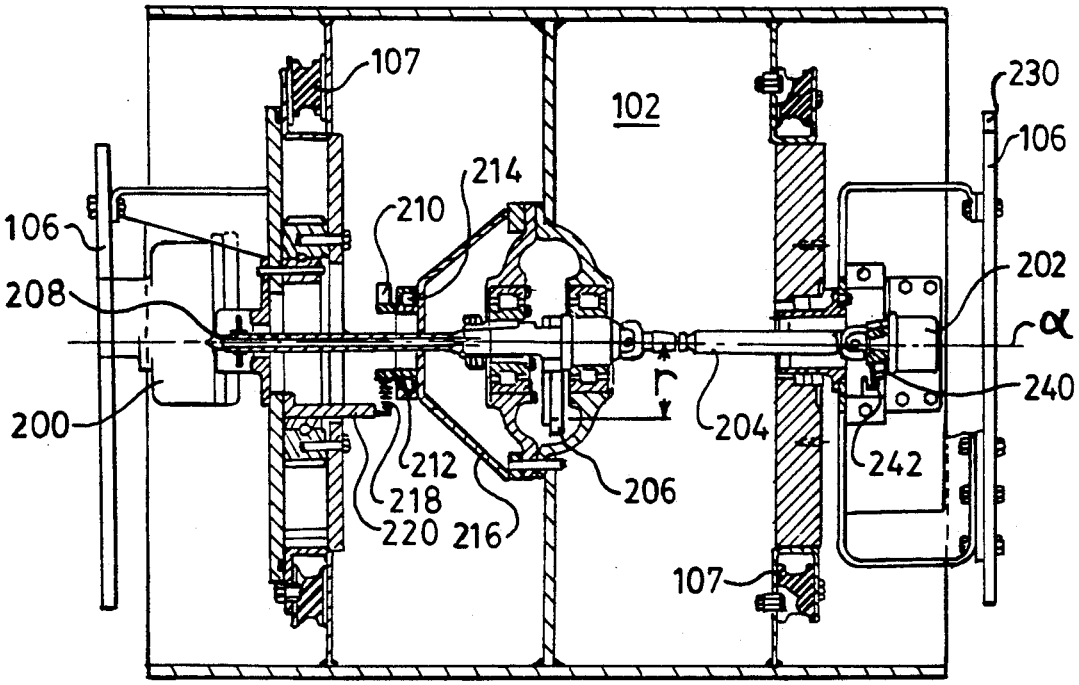
FIG. 2 is a sectional view of a ground contacting member of the vibratory compactor taken along the line 2—2 of FIG. 1.

A vibrating tool (compactor) 100 for increasing the density of a compactible material 10, such as soil, crushed gravel, bituminous mixtures and similar materials, includes a pair of material contacting members 102,104. The material contacting members 102, 104 are typically smooth steel drums that are rotatably mounted on a chassis 106 of the compactor 100. As shown in FIG. 2, the drums 102,104 are vibrationally isolated from the chassis 106 by a plurality of rubber or elastomeric mounting blocks 107.

The vibratory compactor 100 includes an engine 108 driving a hydraulic pump 110 that is operatively connected by hoses or other conduits, not shown, to hydraulic motors that are driven by pressurized hydraulic fluid provided by the pump 110. For example, a hydraulic motor 200 is attached to a forward portion of the chassis 106 and drives the forward drum 102. A second chassis-mounted hydraulic motor 202 is connected to a shaft 204 that is rotatably mounted on the drum 102.

The compactor 100 includes a member 206 eccentrically attached to the rotatable shaft 204. Preferably, the eccentrically attached member 206, alternatively referred to hereinafter as an eccentric mass, eccentric, or eccentrically loaded rotary shaft, comprises two sections having different masses whose respective radial positions can be adjusted by a control rod 208. When the two sections are radially offset 180° with respect to each other, the net eccentric mass is at a minimum value. If the two sections are aligned at the same radial position, the net eccentric mass has a maximum value. Aligning the two sections at an intermediate angle with respect to each other will provide a net eccentric mass having a value between the minimum and maximum values. Thus, three values for the mass of the eccentrically attached member 206, and accordingly three vibratory energy levels, can be provided by the respective position of the control rod 208. Alternatively, the respective positions of the two sections may be controllably shifted automatically to provide a continuous range of values for the mass of the eccentrically attached member 206.

The eccentrically attached member 206 is rotated by the hydraulic motor 202 about an axis $\alpha$, which corresponds with the axis of the shaft 204. The distance between the center of gravity of the eccentrically attached member 206 and the center of rotation $\alpha$ of the shaft 204 represents the radius of rotation of the gravitational center of the eccentrically attached member 206, and is indicated in FIG. 2 by the letter r. When the eccentrically attached member 206 is rotated, unbalanced forces are transferred to the drum 102 thereby imparting a vibratory movement to the drum 102. The drum 104 is resiliently mounted on the chassis 106, in a manner similar to the drum 102, and also has hydraulic motors and an eccentrically loaded rotary shaft mounted thereon.

The compactor 100 includes an accelerometer 210 mounted on a nonrotating element of the drum 102. In the preferred embodiment of the present invention, the accelerometer 210 is mounted on a ring 212 that is connected, by way of a bearing element 214, to a housing 216 substantially enclosing the eccentrically attached member 206. As shown in FIG. 2, the housing 216 is attached directly to the drum 10 and the eccentric mass 206 is supported on bearings mounted within the housing 216. The eccentric mass 206 is therefore able to rotate independently of the ring 212. Rotation of the ring 212 with respect to the chassis 106 is prevented by a pair of springs 218 that extend from respective opposite lateral sides of the ring 212 to a bracket 220. The bracket 220 is mounted on a nonrotating plate, attached to the chassis 106, which supports the drum drive motor 200.

A second accelerometer 230 is mounted on the chassis 106. The accelerometers 210,230 are preferably piezoelectric accelerometers having a frequency range of 1 to 5000 Hz and a sensitivity of 100 mV/g. Accelerometers having these characteristics are commercially available.

A radially extending tab 240 is mounted on the shaft 204 in radial alignment with the eccentrically attached member 206. A transducer 242 is mounted on a bracket attached to the chassis 106 at a position to sense the presence of the tab 240 as it rotates through a position at which it, and accordingly the radially aligned member 206, are oriented vertically at the bottom of their rotation cycle. The use of transducers to sense rotating members is well known in the art, and is not further discussed herein.

The compactor 100 also includes an operator's station 250. The operator's station has a control panel 252 that includes well known vehicle operation and monitoring controls in addition to the control, data entry and display devices associated with the present invention which will be described below in greater detail.

Figure 3:
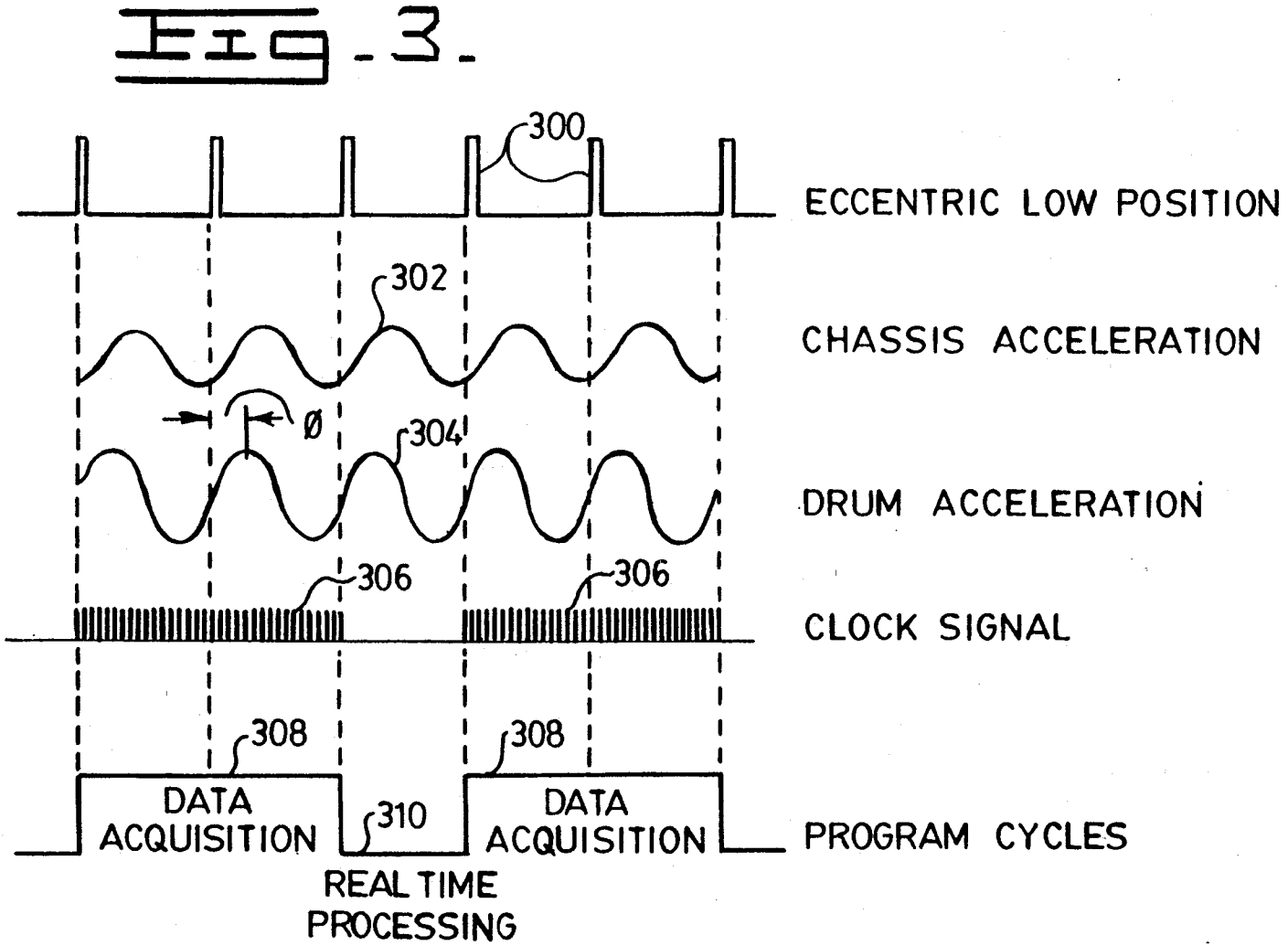
FIG. 3 is a graphical representation of signals representing parameters utilized during operation of the vibratory compactor embodying the present invention.

FIG. 3 illustrates, in graphic form, the relationship between the signals produced by the transducer 242, and the chassis and drum accelerometers 210,230. The transducer 242 provides a signal 300 having a characteristic pulse, or high value, indicative of the passage of the eccentric member 206 past the transducer 242. This signal therefore represents the vertically lowest position of the eccentrically attached member 206. The chassis and drum accelerometers 210,230 respectively provide signals 302 and 304 which are substantially sinusoidal and represent, respectively, the acceleration of the chassis 106 and the drum 102. As will be described below in more detail, a clock provides a timing signal 306 during a data acquisition period 308, which comprises two consecutive rotations of the eccentrically attached member 206. During the third rotation of the member 206 a real time processing period 310 occurs, during which calculations are made.

System Block Diagram

Figure 4:
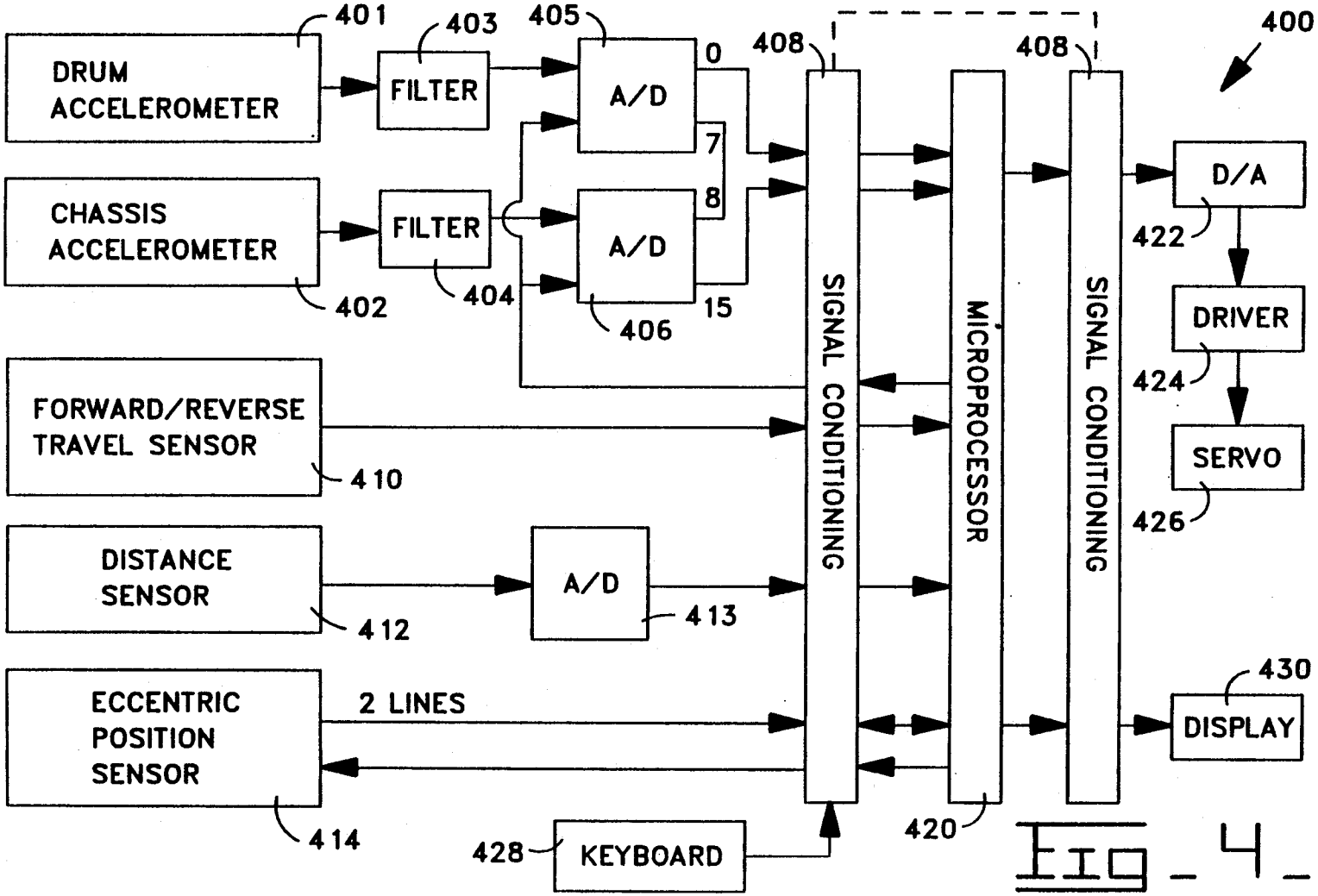
FIG. 4 is a block diagram of the major components of the apparatus for controlling the frequency of a vibrating tool embodying the present invention.

FIG. 4 illustrates in block form the major components of an apparatus 400 for controlling the frequency of the vibrating tool 100. In the preferred embodiment of the present invention, the control apparatus 400 also performs a number of additional control functions, such as calculation of a phase angle $\phi$, the value of which is used control the frequency of vibrations, and calculation of the total force applied by the material contacting member 102 to the compactible material 10. Since the frequency control function of the control apparatus 400 is carried out simultaneously with other control functions, frequency control of the vibrating tool will be described in association with the overall operation of the control apparatus 400.

In FIG. 4, blocks 401 and 402 represent the drum and chassis accelerometers 210,230, respectively. As previously discussed, each of these is a piezoelectric accelerometer that produces analog signals which are delivered to respective filters 403, 404. These filters perform initial conditioning of the signals and, in the preferred embodiment, are sixth order Butterworth filters that are commercially available from the National Semiconductor Corporation. Each of the filtered accelerometer signals is then delivered to a respective analog to digital (A/D) converter 405,406. The converters 405,406 accept the analog input signals and transform them into representative eight-bit digital signals. Because it is desirable that the drum and chassis accelerometer signals be acquired during the same time period by the control system, the A/D converters 405,406 are selected through a single address line. The output signals from the A/D converters 405,406 are provided to a signal conditioning circuit 408 via a 16 bit bus. In the preferred embodiment, the signals delivered to the signal conditioning circuit 408 are voltage signals in the range between negative 5 and positive 5 volts.

A forward/reverse travel sensor 410 also delivers digital signals to the signal conditioning circuit 408 in response to the direction of travel of the vehicle drum. A distance sensor 412, for example a non-contacting transducer such as a radar or sonar device, delivers analog signals to an A/D converter 413, which in turn provides distance related digital signals to the signal conditioning circuit 408. Finally, the eccentric position sensor in block 414, delivers signals relating to the angular position of the eccentric mass 206 rotating within the vehicle drum 102 to the signal conditioning circuit 408. The eccentric position sensor 414 is discussed in further detail below. The signal conditioning circuit 408 provides an electrical interface between various peripheral devices such as those just described and a microprocessor 420. Communications occur directly between the signal conditioning circuit 408 and the microprocessor 420.

The microprocessor 420 delivers an output signal to a digital to analog (D/A) converter 422. This digital signal is converted by the D/A converter 422 into an analog signal which is supplied through a driver circuit 424 to a servo valve 426. The servo valve 426 regulates fluid flow to the hydraulic motor 202 driving the eccentric mass 206 and causes the speed of the eccentric mass to vary in accordance with the signal delivered from the microprocessor 420. This control is bidirectional, depending on the direction of rotation chosen by the operator of the vehicle.

The control system 400 includes a keyboard 428 and a display 430 mounted on the control panel 252 and connected through the signal conditioning circuit 408 to the microprocessor 420. The keyboard 428 is used to communicate with the control system 400, and the display 430 is used to supply information to the vehicle operator.

Figure 5:
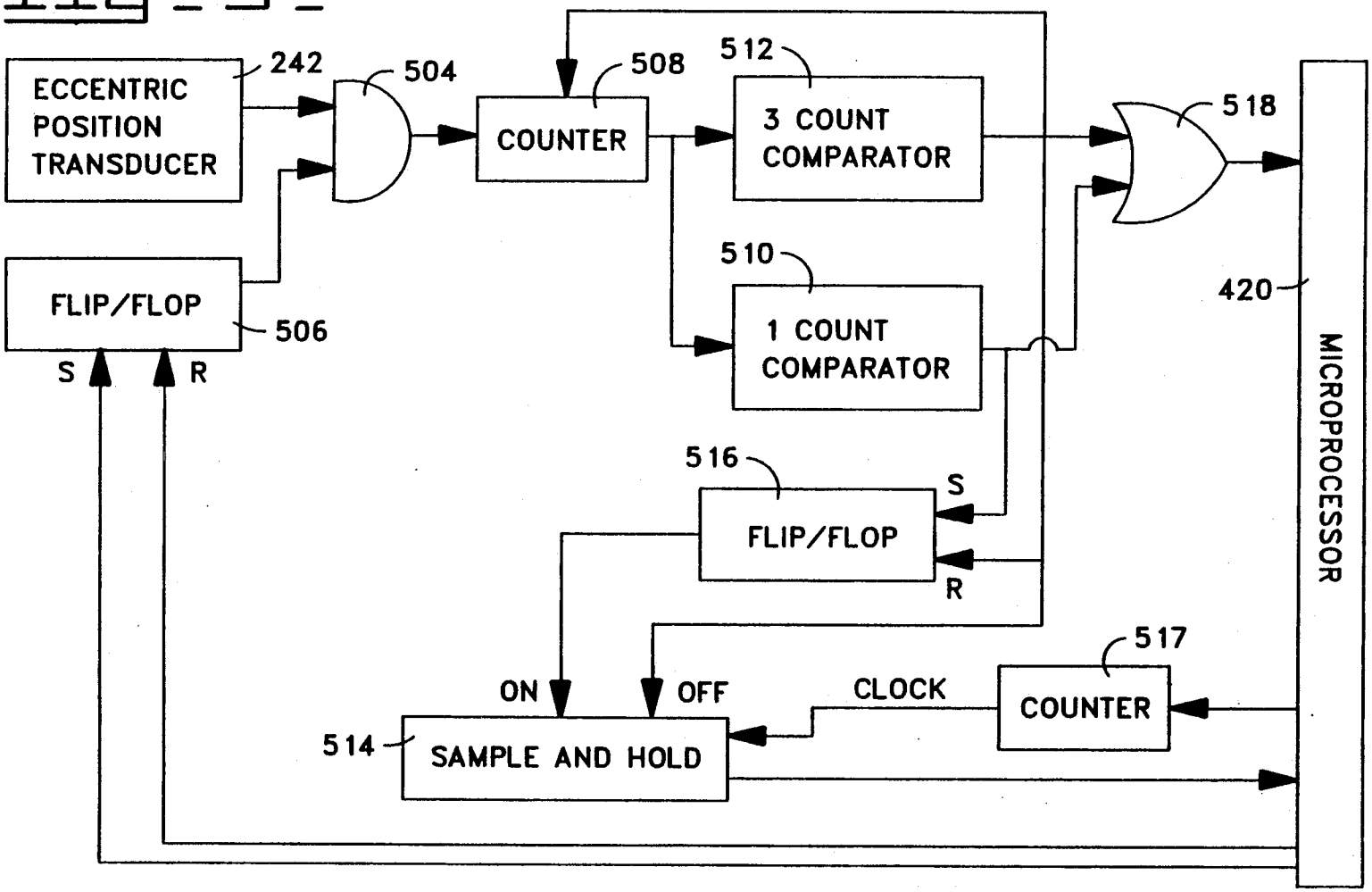
FIG. 5 is a block diagram of a circuit for determining the relative position of an eccentrically attached member rotatably mounted on the vibratory compactor embodying the present invention.

FIG. 5 illustrates in some detail a block diagram of the eccentric position sensor 414. The eccentric position transducer 242 produces the signal 300, which includes an electrical pulse each time the eccentric mass 206 rotates through a position at which it is oriented perpendicular to the ground surface, substantially at the bottom of its rotation cycle. All measurements made by the control system 400 are synchronized by this eccentric position signal 300.

This signal 300 is delivered to a first input terminal of an AND gate 504. A second input terminal of the AND gate 504 is connected to the output terminal of a measurement management flip/flop 506. The set and reset terminals of the flip/flop 506 are connected to respective output terminals of the microprocessor 420. An output terminal of the AND gate 504 is connected to a counter 508, and an output terminal of the counter 508 is connected to respective one and three count comparators 510,512. The output terminal of the one count comparator 510 is connected to the set terminal of a second flip/flop 516, and the output terminal of the three count comparator 512 is connected to the reset terminal of the second flip/flop 516.

The output terminals from the one and three count comparators 510,512 are also connected to respective input terminals of an OR gate 518, which has an output terminal connected to an interrupt terminal of the microprocessor 420. The output terminal of the three count comparator 512 is also connected to a reset terminal of the counter 508, and to the "OFF" terminal of a sample and hold device 514. The output terminal of the second flip/flop 516 is connected to the "ON" terminal of the sample and hold device 514. A second counter 517 has a clock input terminal connected to the microprocessor 420. A clock output terminal from the counter 517 is connected to a clock input terminal of the sample and hold device 514, and an output terminal of the sample and hold device 514 is connected to a second interrupt terminal of the microprocessor 420. In the preferred embodiment, the connections to the microprocessor 420 may be supplied through the signal conditioning circuit 408.

Operation of the eccentric position sensor 414 can be described as follows: the output terminal of the flip/flop 506 that is connected to the input terminal of the AND gate 504 is initially set to a logic "1" by a signal from the microprocessor 420. Receipt of a signal from the eccentric position transducer 242 at the other input terminal of the AND gate 504 causes a pulse to be delivered to the counter 508. The counter 517 divides an eight MHz microprocessor clock frequency by a factor sufficient to provide a data sampling rate of 6.024 KHz. This sampling frequency ensures that at least 120 points per turn of the eccentric mass 206 will be sampled at a rotation speed of 3,000 rpm. Upon the occurrence of a first pulse from the AND gate 504, the one count comparator 510 will deliver an interrupt signal via the OR gate 518 to the microprocessor 420 and will set the second flip/flop 516, which, in turn, will turn "ON" the sample and hold device 514. The sample and hold device 514 will begin accepting clock pulses from the counter 517 at the preferred sampling rate of approximately 6 kHz.

Upon the occurrence of a third pulse from the AND gate 504, the three count comparator 512 will also deliver an interrupt pulse via the OR gate 518 to the microprocessor 420, will reset the second flip/flop 516 and turn "OFF" the sample and hold device 514, and will reset the counter 508 to "ZERO". The data accumulated in the sample and hold device 514 is representative of the time required for the eccentric mass 206 to make two complete revolutions, and is delivered to the microprocessor 420 as interrupt signals.

Description of Computer Software

FIGS. 6–11 describe in flowchart form the computer software utilized in a preferred embodiment of the invention. The flowchart description is sufficiently detailed to permit one skilled in the art of computer programming to draft computer software that will implement the preferred embodiment.

The flowchart and software description can be readily divided into several principle sections for discussion purposes. These include a main program routine, shown in FIGS. 7*a* and 7*b*, a routine for processing sensed data in real time, shown in FIGS. 11*a* and 11*b*, and a routine for processing the data at the end of a vehicle pass, shown in FIGS. 9*a* and 9*b*. In the preferred embodiment, the main routine and the end of pass routine were written in a high level technical language, for example, "C". However, the real time data processing portion of the software was written in assembly language in order to permit the fastest possible execution of the program code.

Figure 6:
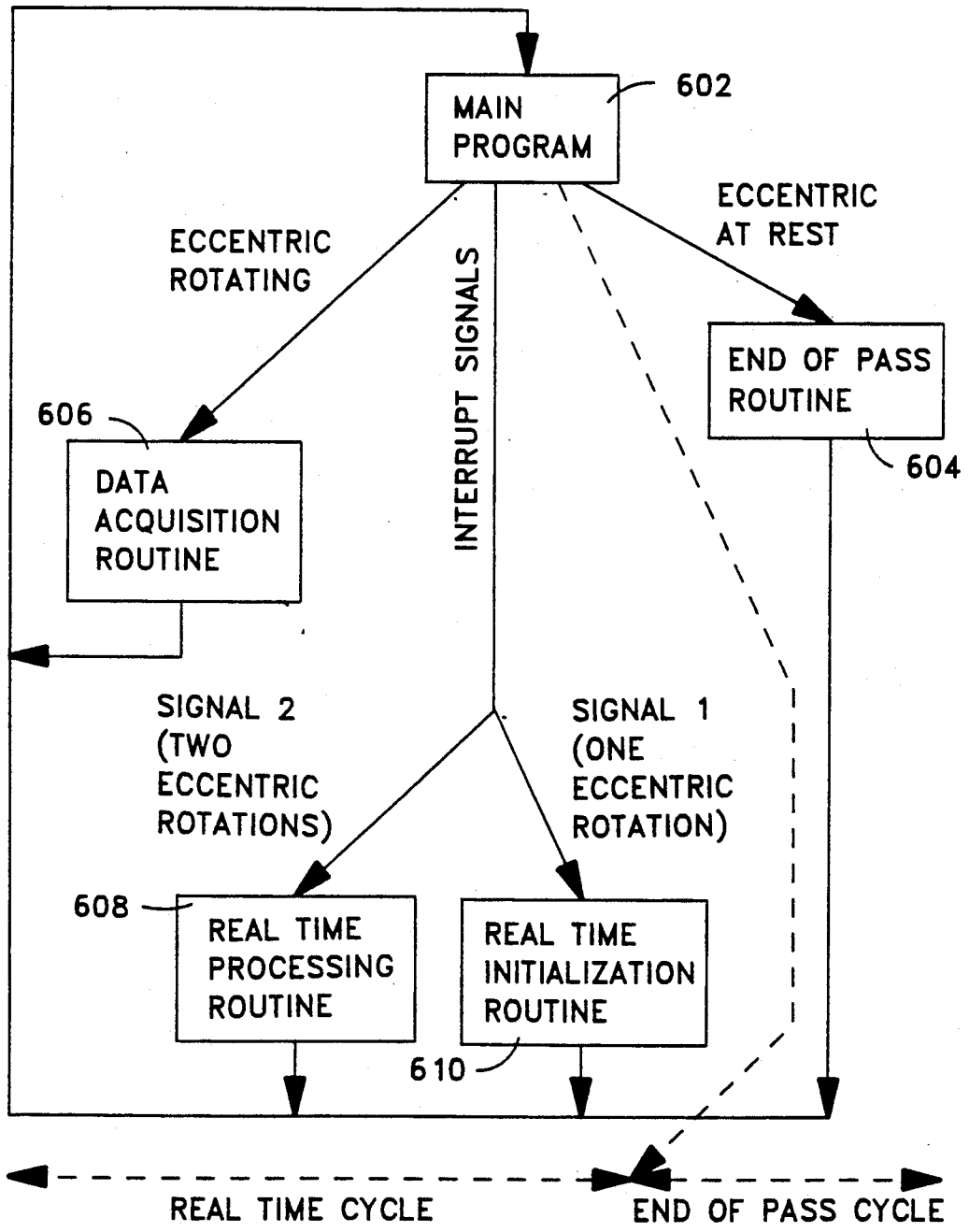
FIG. 6 is a flowchart illustrating the interrupt portion of the software program embodying the present invention.

FIG. 6 provides an overview of the entire software program, and includes software routines that are triggered by interrupts to the microprocessor 420. Beginning at block 602, the main program repeats in a loop with periodic interruptions. If a flag indicating that the eccentric mass 206 is at rest is sensed, the software proceeds to the end of pass routine at block 604 where end of pass processing occurs. When this routine has completed its activity, the program returns to the main program at the block 602.

Figure 8:
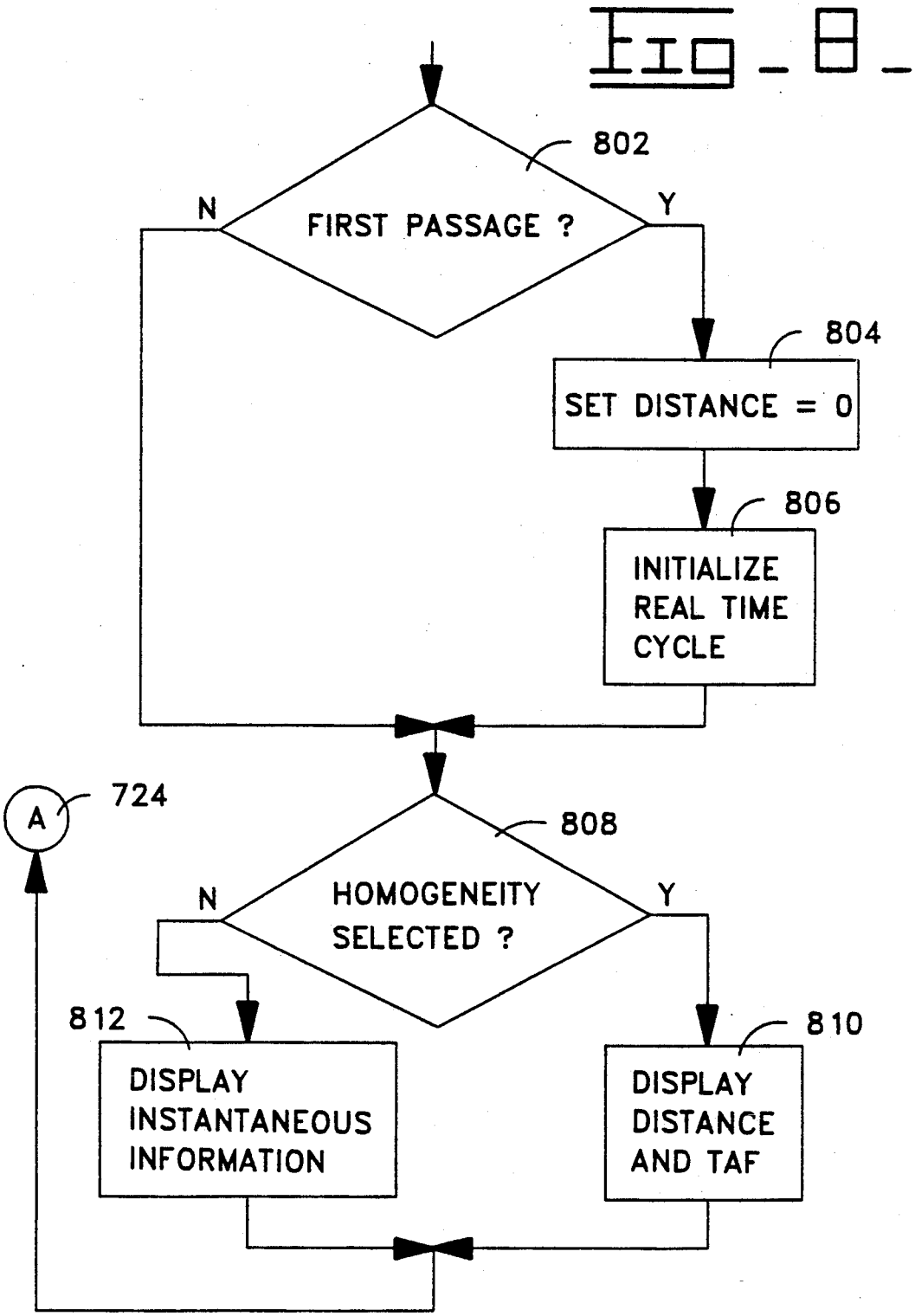
FIG. 8 is a flowchart of the real time initialization routine of the software program embodying the present invention.
Figure 11A:
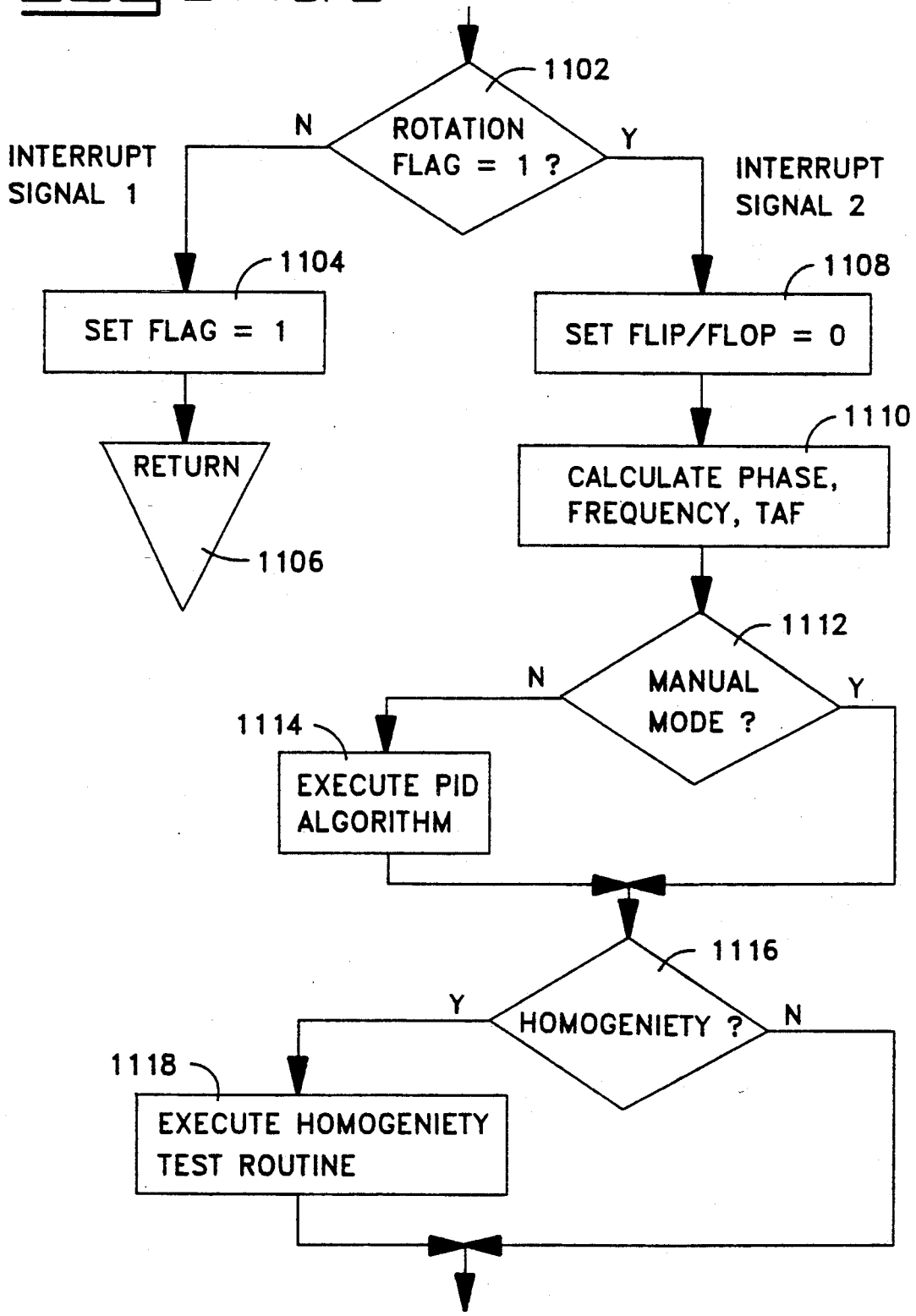
FIGS. 11*a* and 11*b* are flowcharts of the real time processing routine of the software program embodying the present invention.
Figure 11B:
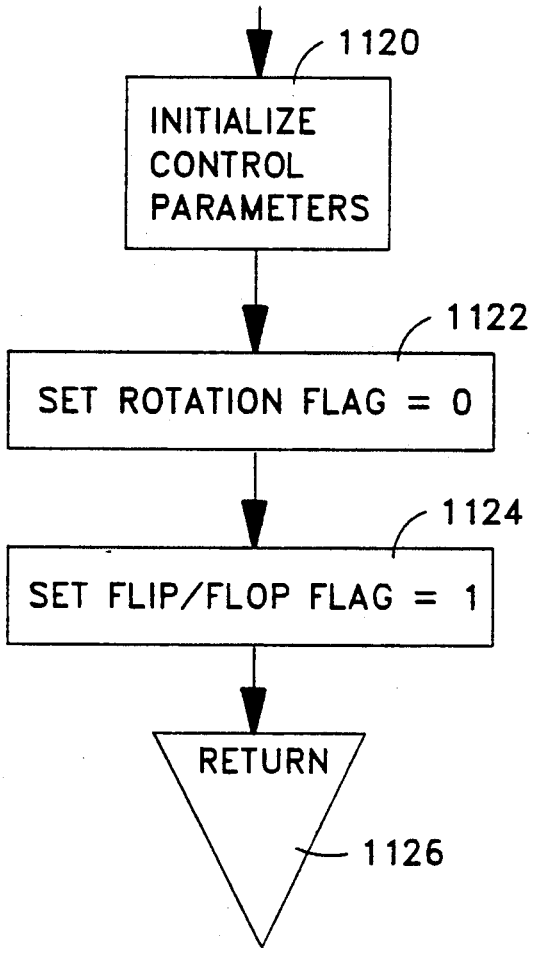

Assuming that the eccentric 206 is rotating, when a first interrupt signal produced by the one count comparator 510 is sensed by the microprocessor 420, control passes to the block 610, where the real time initialization routine described below and shown in FIG. 8, is performed. Control then returns to the program at the block 602. The first interrupt signal indicates that the eccentric mass 206 has been sensed by the transducer 242 and that data acquisition should begin. Following the first interrupt signal, each interrupt pulse from the sample and hold device 514 causes the data acquisition routine at the block 606 to be run as described below and shown in FIG. 10, after which the main program proceeds at the block 602. Upon receiving the second interrupt signal produced by the three count comparator 512, indicating that two complete revolutions of the eccentric 206 have occurred and that data acquisition is complete, processing proceeds to the block 608 where the real time processing routine shown in FIGS. 11*a* and 11*b* is executed, and then resumes at the main program in the block 602.

Figure 7A:
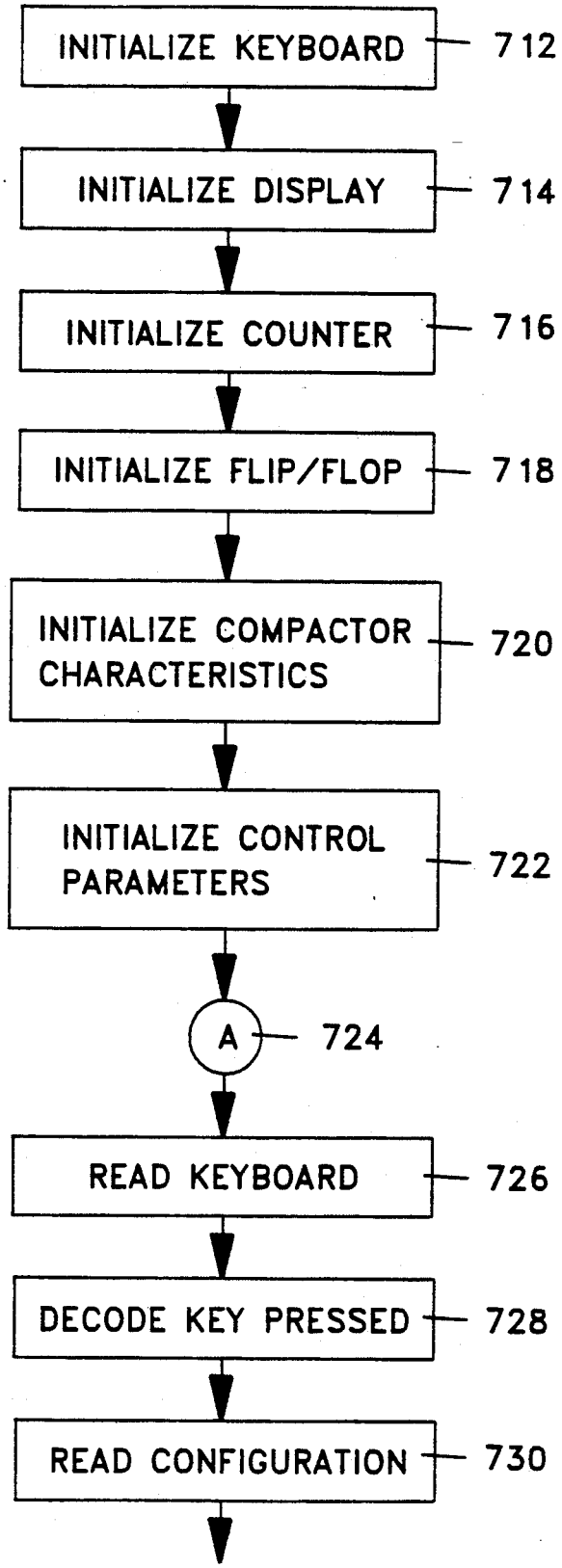
FIGS. 7*a* and 7*b* are flowcharts illustrating the main routine of the software program embodying the present invention.
Figure 7B:
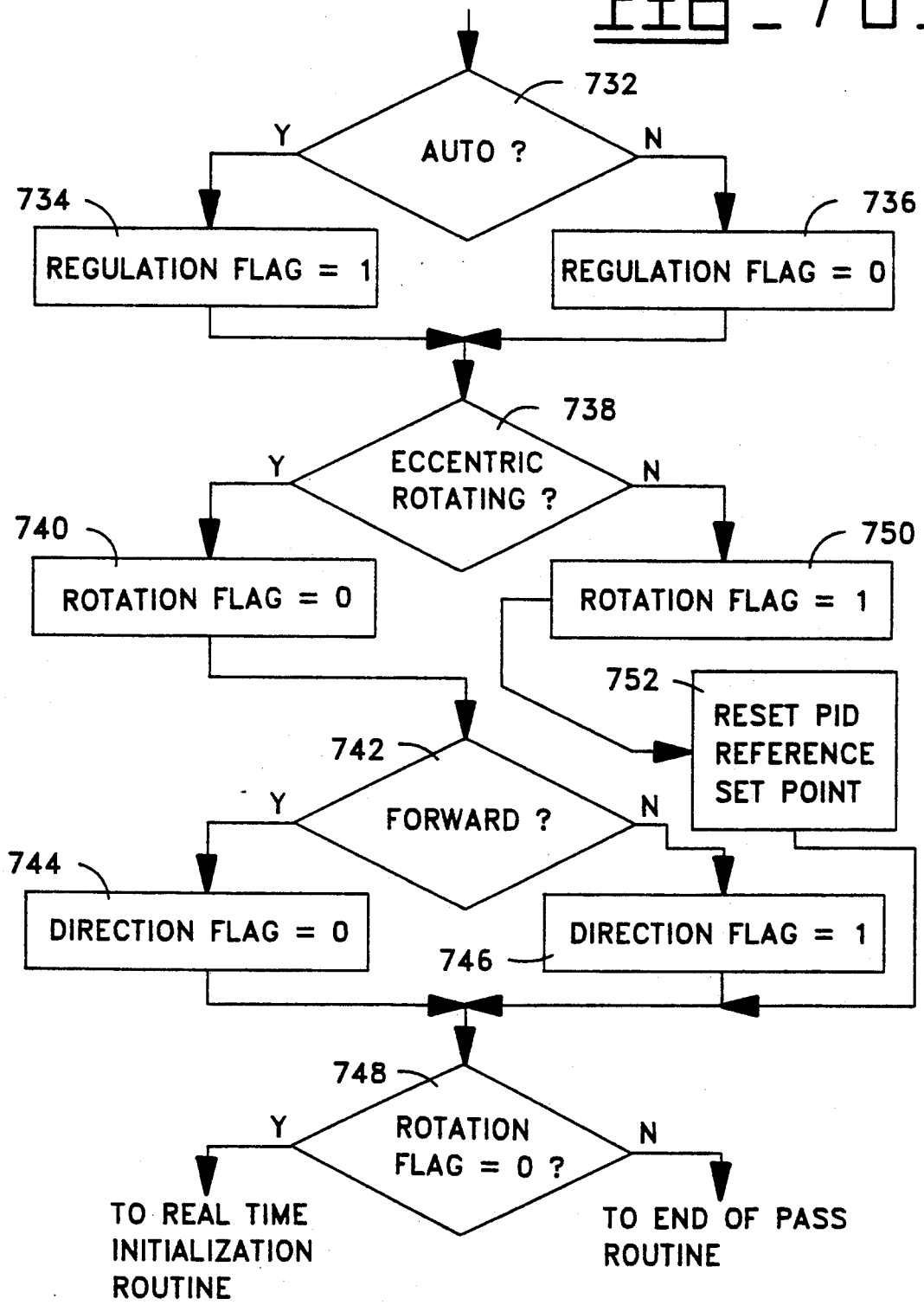

The main software routine is described in FIGS. 7*a* and *b*. The main program consists of a repeating loop which performs several different functions. These functions include initializing variables and peripherals, managing the keyboard and display devices, and controlling execution of the real time program during compaction operation and the end of pass program following compaction.

In blocks 712 through 722, a number of devices and parameters are initialized. These include the keyboard 428, display 430, flip/flop 506, and various other characteristics and parameters, including values for machine parameters such as chassis mass, drum mass and width, and the moments associated with the eccentric mass 206. The blocks 712 through 722 prepare the various items initialized for proper operation throughout succeeding cycles, and are only performed once during each start-up of the control system 400. The keyboard 428 may be a conventional alpha-numeric keyboard or a custom arrangement of special purpose switches. When it is desired to send a signal to the microprocessor 420, a key is pressed and decoded by the processor. Once the key has been sensed and decoded, a flag is set corresponding to the desired action. Once the action has been carried out by the processor, the flag is reset so further communications can occur.

Following initialization, the program proceeds to block 724 which is the beginning of the recurring loop portion of the program. Block 726 and 728 are used to read and decode keyboard information. At block 730, the machine configuration information is read from a register in which it is stored. This information includes the direction of travel of the vehicle, either forward or reverse, and the selection of either automatic or manual operation. If the automatic mode is selected at block 732, the regulation flag is set equal to "ONE" at block 734 while if manual operation is indicated, the regulation flag is set at "ZERO" in block 736. In either case, control passes to block 738 where it is determined if the eccentric 206 is rotating. If the eccentric 206 is rotating, a rotation flag is set equal to "ZERO" at block 740 and control passes to block 742 where the direction of travel is determined. If the vehicle is traveling in a forward direction, a direction flag is set equal to "ZERO" at the block 744. If reverse direction is indicated, the direction flag is set equal to "ONE" at the block 746. In either case, program control then passes to block 748 where the rotation flag setting is read.

If, at block 738, the eccentric 206 is found not to be rotating, control passes to block 750 where the rotation flag is set equal to "ONE" and then to block 752 where a term in a control equation discussed below is set equal to "ZERO". This term indicates the frequency of rotation of the eccentric 206, which is "ZERO" when there is no rotation. The program then proceeds to block 748 where the rotation flag is checked. If the rotation flag is equal to "ZERO", control passes to the real time initialization routine described below and shown in FIG. 8, while if the flag is not equal to "ZERO", control then passes to the end of pass software routine shown in FIGS. 9*a* and 9*b*.

The information contained in the configuration register which is decoded at blocks 730 through 750 provides various information needed by the control system 400. For example, in the event that the manual mode is selected the software continues to take measurements from the accelerometers 210,230, but does not exercise control of the vehicle. If the automatic mode is selected, the software not only takes the measurements, but also controls the frequency of eccentric rotation. The machine characteristics, in particular, the arrangement of the drive elements, influence the distribution of forces, e.g., torque, applied by the machine to the ground. Therefore, the indicated direction of travel influences the calculations that are performed by the control system 400.

The real time initialization routine is described in FIG. 8. The program first checks, at block 802, whether the real time initialization routine is being run for the first time during any one pass of the vehicle over the ground. If the answer is yes, the register in which distance readings are stored is set equal to "ZERO" in the block 804 and the real time cycle is initialized in the block 806. The program then passes to block 808. If this is not the first time through this routine during a particular vehicle pass, control proceeds directly to block 808.

At block 808, the program determines whether the homogeneity function, as described below, has been selected. If so, the program proceeds to block 810 where distance and TAF (total applied force) values are displayed. If the homogeneity function has not been selected, control passes to block 812 where information determined by the control system 400 and further described below, including TAF, frequency $\omega$, phase angle $\phi$, and phase angle reference data, is instead displayed. In either case, control then proceeds back to block 724 where the loop is again performed.

Figure 9A:
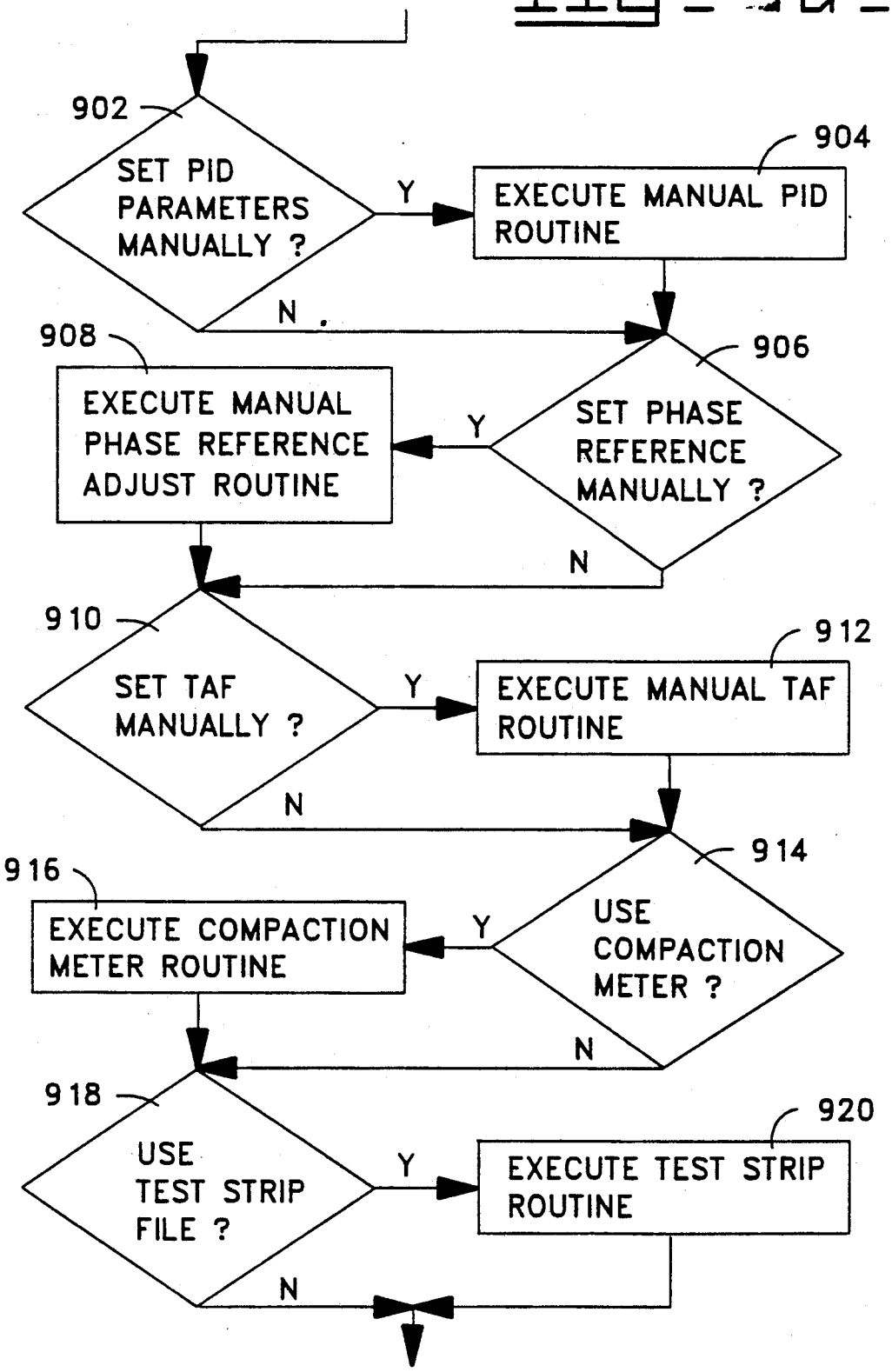
FIGS. 9*a* and 9*b* are flowcharts describing the end of pass routine of the software program embodying the present invention.
Figure 9B:
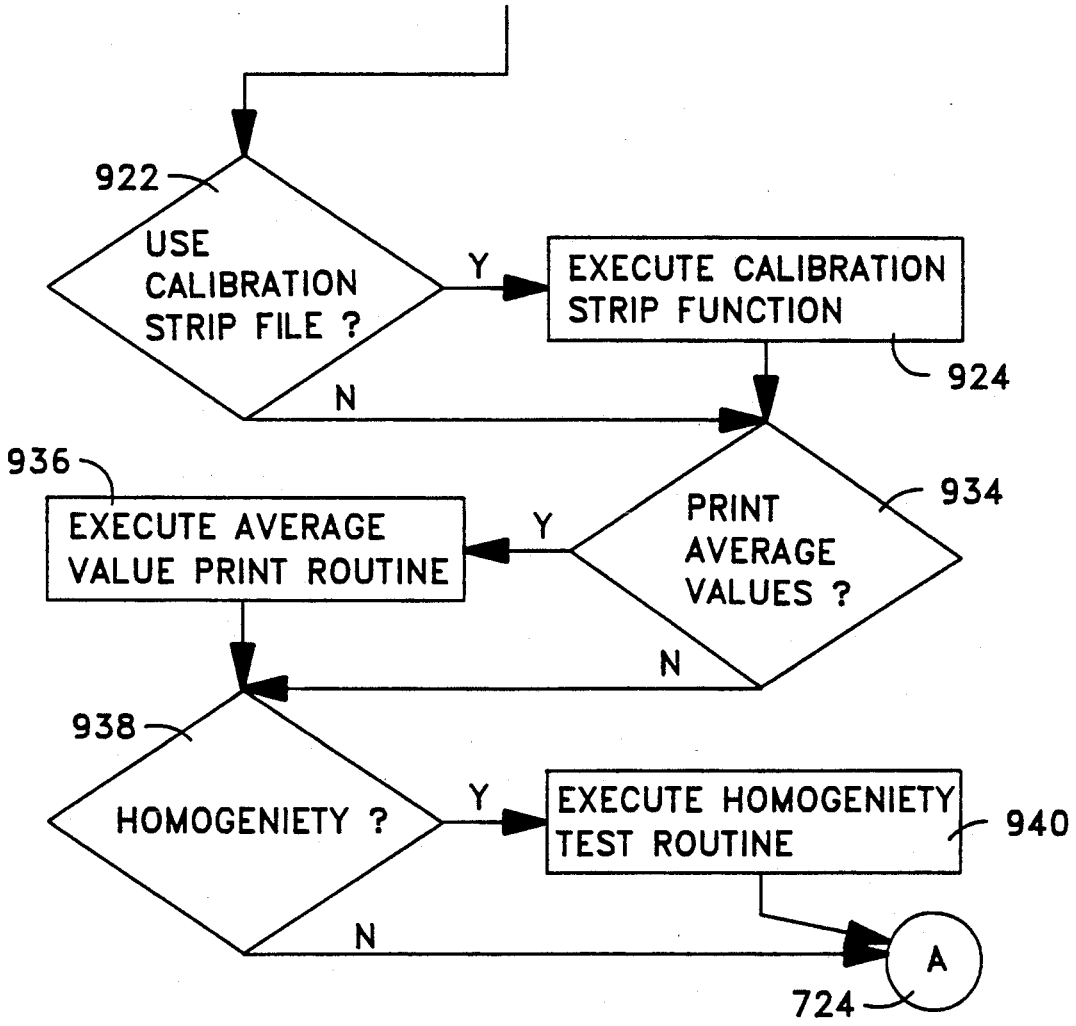
Figure 10:
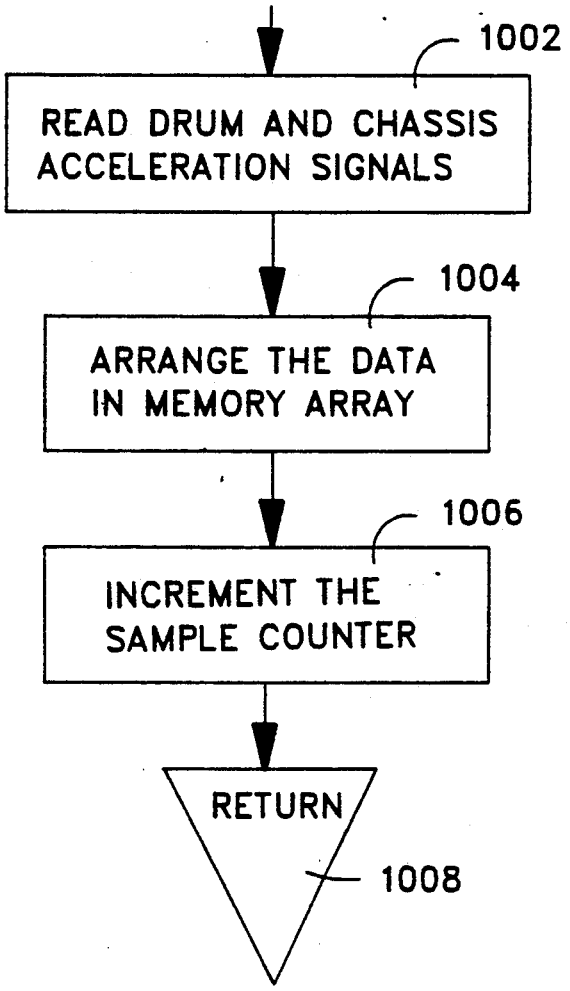
FIG. 10 is a flowchart of the data acquisition routine of the software program embodying the present invention.

FIGS. 9*a* and *b* describe the end of pass software routine. Upon detection of the end of pass signal, a number of routines are optionally performed in accordance with selections made on the system keyboard 428. Three general categories of functions are involved: those relating to manual initialization of various set points, those relating to use of the control system 400 as a compaction meter, i.e., as a meter to evaluate the density of compacted material, and the display of end of pass average values and o phase angle $\phi$ set point values.

At block 902 it is determined if the proportional/integral/derivative (PID) value used in later calculations are to be manually adjusted. If so, at block 904 the manual PID routine is executed and the present PID proportional gain value is displayed. The operator is permitted to either accept this value or modify it. In like manner, the integration and derivative time constants are displayed sequentially for the operator's review and/or modification.

The program then proceeds to block 906 where it is determined whether the set point of the phase reference angle should be manually adjusted. If so, at block 908 the phase adjust routine is performed. Both the forward and reverse phase reference set points are displayed for the operator, who can either accept the displayed values or modify them. If a phase reference set point value less than zero or greater than 360° is selected, the operator is re-prompted to enter a value between these limits. As is known in the art, it is desirable to maintain a phase angle relationship between the eccentric mass 206 and the drum 102 in a range between about 90° to 120° to maintain the vibratory motion of the material contacting member at the resonant frequency. In the preferred embodiment, the phase angle $\phi$ is established at 105°. As explained below, the phase angle $\phi$ is used as the control parameter for regulating the frequency of the rotating eccentric mass 206.

Program control then proceeds to block 910 where the determination is made whether the total applied force (TAF) reference set points should be modified. If so, at block 912 the total applied force reference adjustment routine is run. In a manner similar to the adjustment at block 906 to the phase angle reference, the operator is prompted with the presently stored values for both forward and reverse total applied force reference set points and may change these as desired. Again, a magnitude test is performed to ensure that the selected total applied force reference set points are within a reasonable range.

The next inquiry, at block 914, relates to whether or not the compaction meter function is desired. If so, the compaction meter routine is run at block 916. The compaction meter routine is utilized to calculate the average total applied force at the end of each pass of the vehicle over the material to be compacted. This average force is compared to the total applied force reference set point, and if the calculated force equals or exceeds the set point, the soil density requirement has been attained. The routine at block 916 displays the set point and measured total applied force values in the appropriate one of the forward or reverse direction and displays an end-of-compaction message if the total applied force equals or exceeds the set point.

Control then proceeds to block 918 where it is determined whether a test strip file should be utilized. If so, at block 920 the test strip routine is executed. This routine is described below, and serves to accumulate data in a non-volatile memory area.

In executing the test strip routine at block 920, the operator must first confirm that any existing test strip files should be overwritten by new data. Assuming that this is done, the system accepts new measurements. At the end of each pass, when the eccentric mass is at rest, the direction of travel, the pass number, and the average total applied force during the pass are displayed and stored in memory. This procedure continues until the operator indicates that the test strip file should be closed and that the process is completed.

Program control then proceeds to block 922 where it is determined whether a calibration strip file should be utilized instead of a test strip file. The calibration strip file, also described below, is normally used for small job sites where laboratory testing of material density would be too expensive and would take too much time. The information relating to the calibration strip file is accumulated at the block 924 in a manner similar to that described above for the test strip and is stored in a table in the same manner.

The program prompts the operator to enter information relating to whether the test strip or calibration file should be utilized and requires that the number of necessary passes be provided if the test strip routine is selected. If the calibration method is chosen by the operator, he must supply both forward and reverse total applied force percentage variation thresholds to the system. The computer then calculates the total applied force reference set points in both the forward and reverse travel directions as described below, and displays the results to the operator. These values are stored in the protected memory area.

Control then passes to block 934 where it is determined whether average values are to be provided to a RS232 output port connected to the microprocessor 420 at the end of a pass. If so, at block 936 the routine is run to transmit values for TAF, phase angle $\phi$, drum and chassis acceleration, eccentric frequency $\omega$, and, optionally, the test and calibration strip files.

Finally, at block 938 it is determined whether a homogeneity test, as described below, is to be performed. If so, this test is run at block 940 after which program control loops back to block 724.

When the first interrupt signal is received from the one count comparator 510, the sample and hold device 514 begins accepting clock pulses from the counter 517. Each clock pulse generates an interrupt to the microprocessor 420, which causes the main program to be suspended while the data acquisition routine is run. This is described in FIG. 10, where the routine reads the analog to digital converter outputs from the drum and chassis accelerometers 210,230 and places the values in an array in memory. At block 1002 the signals are read into the microprocessor 420, and at block 1004 the data is appropriately arranged in memory.

A single complete reading of the accelerometer values requires two successive readings of the data, because the A/D convertors 405,406 each provide 12 bit precision output signals and the microprocessor 420 can only accept one 16 bit data word at a time. Therefore, during a first microcomputer read cycle, the 8 least significant bits from the drum accelerometer A/D convertor 405 are received and stored in a computer register as the 8 least significant bits of the data word, and the 8 least significant bits from the chassis accelerometer A/D convertor 406 are read and stored as the 8 most significant bits of the data word. On the next microprocessor cycle, the 4 most significant bits from the drum A/D convertor 405 are stored as the least significant bits of a data word in a second computer register, and the next four bits of the data word are padded with "ZEROS". The 4 most significant bits of the chassis A/D convertor 406 are then stored as the next four bits of the data word, followed by four more bits of padding, producing a second 16 bit data word.

The computer registers therefore contain respective data words arranged in the form "cccccccddddddddd" followed by "0000CCCC0000DDDD".

These data are then stored in respective 16 bit drum and chassis memory arrays by reassembling the data in the form "0000DDDDdddddddd" and "0000CCCCcccccccc". Therefore, taken together, the two successive readings produce two 16 bit words representing simultaneous chassis and drum acceleration values. Following the reading and storing of the data, control passes to block 1006 where the sample counter is incremented, and then to block 1008 which terminates the interrupt program and returns execution to the main program at the same point at which interruption occurred. The data acquisition routine is run each time an interrupt is generated by the sample and hold device 514, until the second interrupt signal is received by the microprocessor 420 from the three count comparator 512, indicating that two complete revolutions of the eccentric 206 have occurred. At this time, the two memory arrays contain a series of acceleration values for a complete data acquisition period.

The measurement process is shown graphically in FIG. 3, where the signal 300 includes pulses produced once each revolution by the eccentric 206. The first pulse in the signal 306 allows the clock signals to be accepted by the sample and hold device 514. Each clock pulse generates an interrupt during the data acquisition portion of the curve 308. Completion of two eccentric cycles ends the data acquisition time period, and begins the real time processing portion of the curve 310. These alternating time periods continue as long as the control system 400 continues to accumulate data during a pass of the vehicle over the material 10 to be compacted.

The real time processing routine shown in FIG. 11*a,b* is initiated by an interrupt generated by the rotation of the eccentric mass 206 and produced by the three count comparator 512. At block 1102 the rotation flag is checked to determine whether it is equal to "ONE". If not, the flag is set to "ONE" at block 1104 and the routine terminates at block 1106, returning control to the main program. This indicates that data acquisition is still underway and that no processing of the data should yet occur. At the end of two rotations of the eccentric mass 206, the test at block 102 will show that the rotation flag has been set to a value of "ONE" and that the data acquisition cycle is complete. This causes the flip/-flop 506 to be reset to "ZERO" at block 1108, completing the acquisition cycle and beginning the real time processing of the data.

The chassis and drum acceleration data files are processed separately. Total applied force (TAF) data taken over consecutive eccentric mass rotation cycles may vary somewhat, but variations become negligible when two successive cycles are combined. At block 1110, and as described more fully below, the data is processed separately and then averaged. Calculations relating to phase angle $\phi$, frequency $\omega$, and total applied force TAF are performed.

Control of Frequency

At block 1112, it is determined whether the manual mode has been selected. If not, control proceeds to block 1114 where the PID algorithm is executed. The PID algorithm calculates a control signal utilizing the previous phase angle measurement as a starting point. The algorithm is designed to maintain equality between the measured and set point phase angles. The error derived from the PID algorithm is sent as a control signal through the D/A converter 422 to control the servo valve 426, which, in turn, controls the speed of rotation of the eccentric mass 206.

Control then passes to block 1116 where it is determined whether or not the homogeneity test is required. If so, the homogeneity procedure is executed at block 1118. In this routine, data from thirty eccentric mass rotational cycles are accumulated, representing roughly two meters of vehicle travel. The total applied force value is averaged over the thirty cycles, and the precise distance covered by the vehicle is measured by the distance sensor 412 and accumulated by the microprocessor 420. These two data are stored in a table, and can be used to trace the total applied force in steps of roughly two meters each. This will give the operator an indication of the homogeneous nature of the compaction being attained.

Following this procedure, or if the function is not desired, control proceeds to block 1120 where control parameters are initialized. In particular, the rotation flag is set to "ZERO" at block 1122, and the flip/flop 506 is set to "ONE" at block 1124. This permits the measurement cycle 308 to repeat upon the next occurrence of a first interrupt signal. Following this reinitialization, the program proceeds to block 1126 which concludes the routine, and the main program proceeds from the point at which it was interrupted.

If the manual mode is selected at block 1112, the PID algorithm at block 1114 is not executed, program control passes directly to the homogeneity test at block 1116, and proceeds as discussed above.

Calculation of the Phase Angle, Frequency and TAF

The sum of all internal and external forces applied on the drum 102 must equal zero. Therefore, the upwardly vertical reactive force applied by the material 10 to the drum, or material contacting member 102, must equal the sum of the downwardly vertical forces applied by the drum to the compactible material. This downwardly vertical force is the compacting force applied by the vibrating tool, or drum 102, to the compactible material 10, and is identified herein as "TAF", the total applied force. The total applied force, TAF, is calculated as described below. Also, the terms "vertical" and "vertically", as used herein, mean a direction perpendicular to the ground surface.

As described above, the values of the vertical acceleration of the drum $F_{vd}$, and of the chassis, $F_{vc}$, are recorded for each clock count during two (2) consecutive rotations of the eccentric mass. During the third rotation, the maximum value of the drum acceleration $F_{vd}$, occurring during each of the two preceding rotation periods is determined. For purposes of the following description, the maximum positive values of the drum acceleration, i.e., the maximum value of acceleration in the upwardly vertically direction, sensed during the two consecutive periods are identified as $F_{vd1}$ and $F_{vd2}$. The corresponding values of the chassis acceleration, i.e., the value of the chassis acceleration at the time the drum acceleration is at a maximum value, are designated $F_{vc1}$ and $F_{vc2}$.

The angular displacement of the eccentric mass 206, i.e., the radial angle traversed by the eccentric mass from the sensed position to the position of the eccentric mass 206 at the time the vertical acceleration of the drum $F_{vd}$ has a maximum value, is designated as the phase angle, $\phi$. The phase angles for each of the two measured eccentric mass rotational cycles are designated $\phi_1$ and $\phi_2$ respectively, and are calculated according to the following formula:

$$\phi_1 = \frac{360^\circ \times R_1}{n_1} \text{ and } \phi_2 = \frac{360^\circ \times R_2}{n_2},$$

where $R_1$ and $R_2$ are the clock counts at which the maximum drum acceleration values $F_{vd1}$ and $F_{vd2}$ respectively occur, and $n_1$ and $n_2$ are the total number of clock counts occurring during the rotation of the eccentric mass through each respective 360° rotary cycle.

The frequency, $\omega$, of the rotating eccentric mass 206 is calculated by averaging the frequency during the two consecutive eccentric mass rotational cycles, i.e.,:

$$\omega = \frac{\text{Clock Frequency} \times 2}{n_1 + n_2}$$

where the clock frequency is the frequency of the signal provided by the counter 517, and $n_1$ and $n_2$ are, as above, the total number of clock counts occurring during each respective rotation of the eccentric mass through one 360° revolution.

The maximum acceleration values of the drum 102 during the two consecutive rotation cycles $F_{vd1}$ and $F_{vd2}$, and the corresponding acceleration values of the chassis 106, $F_{vc1}$ and $F_{vc2}$ are also averaged. Therefore, the values of $F_{vd}$ and $F_{vc}$ represent an average value of these parameters for two rotational cycles of the eccentric mass 206.

Calculation of TAF, the total force applied by the drum 102 to the compactible material 10 is carried out by adding the static force, the dynamic force, and the vertical vectorial component of the centrifugal force. The static force is:

$$\text{Static Force} = M_v \times g,$$

where $M_v$ is the respective mass of the vehicle 100 bearing on the compactible material 10, and g is the gravitational constant, (9.81 m/s$^2$).

The dynamic force component of the total applied force is determined by the following formula:

$$\text{Dynamic Force} = (M_d \times F_{vd}) + (M_c \times F_{vc}),$$

where $M_d$ is the mass of the drum 102, and $M_c$ is the mass of the chassis 106. The mass of the chassis $M_c$ is the respective mass of the vehicle, $M_v$, minus the mass of the drum $M_d$, i.e., $M_c = M_v - M_d$.

The total centrifugal force, $F_c$, of the rotating eccentric member 206 is:

$$F_c = M_e \times r \times \omega^2$$

where $M_e$ is the mass of the eccentric member 206, and r is the radius of rotation of the gravitational center of the eccentric member 206 from the center of rotation $\alpha$.

The centrifugal force component contributing to total applied force, TAF, is the vertical vectorial component of the total centrifugal force $F_c$, and is calculated as follows:

$$\text{Centrifugal Force} = F_c \times \cos \phi.$$

Therefore TAF, the total force applied vertically by the ground contacting member 102 to the compactible material 10 is represented by the formula:

$$TAF = (M_v \times g) + (M_d \times F_{vd}) + (M_c \times F_{vc}) + (F_c \times \cos \phi).$$

In summary, the total force applied to a compactible material by a vibratory tool is determined by independently measuring the vertical acceleration of the material contacting member and the chassis upon which the member is mounted. Calculation of the dynamic and centrifugal forces is made when the material contacting member, or drum, is at its lowest position. This corresponds to the time at which the most force is being applied to the ground by the drum and accordingly the time at which the drum has a maximum acceleration value. Data are acquired during two consecutive cycles of rotation of the eccentric mass 206, and calculation of the total applied force, i.e., the sum of the static, dynamic and centrifugal forces, is made for each cycle and averaged. Thus, a value representing the total applied force is provided after every third rotation of the eccentric mass 206.

Similarly, averaged values of the phase angle $\phi$ and the rotational frequency $\omega$ of the vibration inducing eccentric mass 206 are provided after every third rotation of the eccentric mass.

Industrial Applicability

The advantages of controlling the operation of a compacting machine at the resonant frequency during a compacting operation are well illustrated in the following chart. Tests were carried out by a compactor on identical materials and under similar operating conditions. Only the frequency of the vibration-inducing eccentrically loaded rotating shaft was varied. The first column shows the values of the listed parameters measured during a traditional method of compaction in which the compactor was operated at its maximum frequency. This frequency was on the order of about 37 Hz. In the second column, the frequency of the rotating eccentric mass was maintained at the resonant frequency which was typically about 25 Hz.

| Parameter | Maximum Frequency | Resonant Frequency |
|---|---|---|
| Centrifugal Force | 17.0 t | 9.5 t |
| Total Applied Force (TAF) | 12.5 t | 17.0 t |
| Amplitude (Drum) | 2 mm | 3 mm |
| Output - 100% Proctor Density | 104 t/h | 139 t/h |
| Vibration Power | 30 kW | 21 kW |
| Energy per ton | 1040 kJ | 545 kJ |

As can be seen, the production output of the compactor, i.e., the tons of material per hour that is compacted to 100% Proctor density, is significantly greater when the machine is operated at the resonant frequency. An added benefit is that significantly less centrifugal force is produced at the resonant frequency which considerably reduces wear and fatigue of the mechanical components of the compactor. Also, it can be seen that the total applied force (TAF) transmitted to the ground increases from 12.7 tons to 17 tons. This increase explains the improved production performance of the compactor. If we divide the vibration power by the production output, we see that 1040 kJ of energy are required to compact one ton of material at the maximum frequency output of the compactor, whereas only 545 kJ of energy is required to compact one ton of material at the resonant frequency.

The energy savings attributable to operating a compactor at the resonant frequency is therefore very significant. The present invention provides an apparatus for controlling the frequency of vibrations imparted to the ground under varying operating conditions. This permits continuous operation at the resonant frequency thereby optimizing the efficiency of the compacting machine.

Other aspects, objects and advantages of this invention can be obtained from a study of the drawings, the disclosure, and the appended claims.

We claim:

1. An apparatus for controlling the frequency of vibration of a compacting machine having a material contacting member, a shaft rotatably mounted on the material contacting member, a member eccentrically mounted on said shaft, means for rotating said eccentrically mounted member independently of the rotation of said material contacting member and imparting a vibratory motion to said material contacting member, and means for sensing the position of said eccentrically mounted member and producing a signal corresponding to the presence of said member at a predetermined radial position, the improvement comprising:

an accelerometer mounted on said material contacting member and positioned to produce a signal representative of a vertical acceleration of said material contacting member;

clock means for producing a signal having a predetermined frequency;

means for receiving said acceleration signal, said eccentric member position signal and said clock signal, determining the time at which the eccentrically mounted member is at the predetermined position and the time at which the acceleration signal has a maximum value, measuring the time difference between the position signal and the acceleration signal maximum value, calculating the value of a radial angle ($\phi$) traversed by said eccentrically mounted member during said time difference, and producing a signal corresponding to said calculated radial angle ($\phi$); and means for receiving said signal corresponding to said calculated radial angle ($\phi$), comparing the value of said calculated radial angle ($\phi$) signal with a reference value, producing a control signal representative of the difference between said radial angle ($\phi$) signal and said reference value, and delivering said control signal to said means (202) for rotating the eccentrically mounted member.

2. An apparatus, as set forth in claim 1, wherein said means for receiving said acceleration, position and clock signals, includes means for measuring the time difference between the position and acceleration maximum value signals for two consecutive cycles of said eccentrically mounted member, averaging the two measured time differences, calculating the average value of the radial angle ($\phi$) traversed by said eccentrically mounted member during the two consecutive cycles, and producing a signal corresponding to the calculated average value of said radial angle ($\phi$).

3. An apparatus, as set forth in claim 1, wherein said apparatus includes means for visually displaying said signal corresponding to said calculated radial angle ($\phi$).

4. A method for controlling the frequency of vibration of a compacting machine having a material contacting member, a member eccentrically attached to a shaft mounted on said material contacting member, means for rotating said eccentrically attached member, and means for sensing the position of said eccentrically attached member and producing a signal corresponding to the presence of said member at a predetermined radial position, the improvement comprising:

producing a signal representative of a vertical acceleration of said material contacting member;

producing a time signal having a predetermined frequency;

receiving said acceleration, position and time signals;

determining the time at which said eccentrically attached member is at the predetermined position;

determining the time at which said acceleration signal has a maximum value;

measuring the time difference between said position signal and the maximum value of said acceleration signal;

calculating the value of a radial angle ($\phi$) traversed by said eccentrically attached member during said time difference;

producing a signal corresponding to the value of said calculated radial angle ($\phi$);

comparing the value of said calculated radial angle ($\phi$) signal with a reference value;

producing a control signal representative of the difference between said calculated radial angle ($\phi$) signal and said reference value; and controlling said means for rotating the eccentrically attached member in response to said control signal.

5. A method, as set forth in claim 4, including the steps of:

measuring the time difference between the position signal and the maximum value of said acceleration signal for two consecutive rotational cycles of the eccentrically attached member;

averaging the two measured time differences;

calculating the average value of the radial angle ($\phi$) traversed by the eccentrically attached member during the two consecutive rotational cycles; and producing a signal corresponding to the averaged value of said radial angle ($\phi$).

6. A method, as set forth in claim 3, including the step of visually displaying the value of said calculated radial angle ($\phi$).

* * * * *